US012048367B1

(12) United States Patent
Kooyers

(10) Patent No.: US 12,048,367 B1
(45) Date of Patent: Jul. 30, 2024

(54) UTILITY STRAP ASSEMBLY

(71) Applicant: Dustin Kooyers, Grand Haven, MI (US)

(72) Inventor: Dustin Kooyers, Grand Haven, MI (US)

( * ) Notice: Subject to any disclaimer, the term of this patent is extended or adjusted under 35 U.S.C. 154(b) by 0 days.

(21) Appl. No.: 16/927,774

(22) Filed: Jul. 13, 2020

Related U.S. Application Data

(63) Continuation-in-part of application No. 15/226,320, filed on Aug. 2, 2016, now Pat. No. 10,918,195, which is a continuation of application No. 13/920,722, filed on Jun. 18, 2013, now Pat. No. 9,402,458.

(51) Int. Cl.
*A45F 5/02* (2006.01)
*A41F 1/00* (2006.01)

(52) U.S. Cl.
CPC ..... *A45F 5/021* (2013.01); *A41F 1/008* (2013.01); *A45F 2200/0516* (2013.01); *A45F 2200/0575* (2013.01); *A45F 2200/0591* (2013.01)

(58) Field of Classification Search
CPC ..... A45F 5/021; A41F 1/008
See application file for complete search history.

(56) References Cited

U.S. PATENT DOCUMENTS 408,179 A 7/1889 Katzenberg
411,416 A 9/1889 Blakesley
439,375 A 10/1890 Blakesley
583,986 A 6/1897 Drost
603,760 A 5/1898 Gair
645,756 A 3/1900 Puellmann
653,779 A 7/1900 Phillips
814,599 A 3/1906 Freyer
837,156 A 11/1906 Townsend
881,044 A 3/1908 Audley
1,045,713 A 11/1912 Lewis
1,618,147 A 2/1927 Carpenter
1,653,288 A 12/1927 Johnson
1,886,718 A 11/1932 Noel
1,887,780 A 11/1932 Noel
1,908,038 A 5/1933 Mackenzie
(Continued)

*Primary Examiner* — Derek J Battisti
(74) *Attorney, Agent, or Firm* — King & Partners, PLC

(57) ABSTRACT

A utility strap assembly for use in association with an article of clothing, for integration with an article of clothing, and/or to be worn by a user, including: a primary strap member, wherein the primary strap member includes a length, a height, a thickness, a first end, a second end, an inner surface, an outer surface, an upper end, and a lower end; a first bracket, wherein the first bracket is positioned on at least one of the inner surface and the outer surface of the belt member; a second bracket, wherein the second bracket is positioned on at least one of the inner surface and the outer surface of the belt member; wherein the first bracket and the second bracket are spaced apart from one another to define a track therebetween; wherein a hook fastener material is associated with at least a portion of the inner surface of the primary strap member; wherein a loop fastener material is associated with at least a portion of the outer surface of the primary strap member; and wherein the hook and loop fastener materials cooperate to releasably secure the primary strap member on, to and/or around a user.

3 Claims, 11 Drawing Sheets

(56) References Cited

U.S. PATENT DOCUMENTS

| | | | | |
|---|---|---|---|---|
| 1,935,984 | A | 11/1933 | Noel | |
| 2,149,550 | A | 9/1939 | Richards et al. | |
| 2,342,210 | A | 2/1944 | Murphey | |
| 2,465,536 | A | 3/1949 | Hyman | |
| 2,495,029 | A | 1/1950 | Spengler | |
| 2,498,685 | A | 2/1950 | Hyman | |
| 2,586,457 | A | 2/1952 | Epstein | |
| 2,655,707 | A | 10/1953 | Rubin | |
| 3,004,315 | A | 10/1961 | Masure | |
| 3,168,972 | A | 2/1965 | Parlante et al. | |
| 3,171,409 | A | 3/1965 | Cetrone | |
| 3,210,820 | A | 10/1965 | Humiston | |
| 3,250,448 | A | 5/1966 | Clark | |
| 3,300,109 | A | 1/1967 | Clark | |
| 3,441,185 | A | 4/1969 | Moomaw | |
| 3,495,770 | A | 2/1970 | Seltmann, Jr. | |
| 3,501,775 | A | 3/1970 | Demers et al. | |
| 3,591,866 | A | 7/1971 | Jensen | |
| 3,655,106 | A | 4/1972 | Wojcinski | |
| 3,731,858 | A | 5/1973 | Baker | |
| 3,866,276 | A | 2/1975 | Perkins | |
| 3,902,639 | A | 9/1975 | Rogers | |
| 3,904,091 | A | 9/1975 | Jones | |
| 3,915,361 | A | 10/1975 | Perkins | |
| D240,225 | S | 6/1976 | Baker | |
| D251,758 | S | 5/1979 | Penrod | |
| 4,253,592 | A | 3/1981 | Anderson | |
| 4,303,187 | A | 12/1981 | Berman | |
| D264,240 | S | 5/1982 | Bianchi | |
| 4,341,331 | A | 7/1982 | McDougall | |
| 4,342,410 | A | 8/1982 | Sloan | |
| 4,356,943 | A | 11/1982 | Berman | |
| 4,384,372 | A | 5/1983 | Rector | |
| 4,424,924 | A | 1/1984 | Perkins | |
| 4,463,455 | A | 8/1984 | Kirk | |
| D276,476 | S | 11/1984 | Johansson et al. | |
| 4,504,001 | A | 3/1985 | Nichols | |
| 4,544,089 | A | 10/1985 | Tabler | |
| 4,619,020 | A | 10/1986 | Lecher, Sr. | |
| 4,644,676 | A | 2/1987 | Stern | |
| 4,736,853 | A | 4/1988 | O'Mara | |
| 4,747,527 | A | 5/1988 | Trumpower, II | |
| 4,787,540 | A | 11/1988 | Barry | |
| 4,796,790 | A | 1/1989 | Hamilton | |
| 4,848,625 | A | 7/1989 | Lucia | |
| 4,923,105 | A | 5/1990 | Snyder | |
| 4,962,873 | A | 10/1990 | Schattel | |
| D313,121 | S | 12/1990 | Dise | |
| 4,993,614 | A | 2/1991 | Bonofiglo | |
| 5,054,670 | A | 10/1991 | Gallagher | |
| 5,100,036 | A | 3/1992 | Rogers et al. | |
| 5,152,443 | A | 10/1992 | Hagan | |
| 5,201,448 | A | 4/1993 | Schue | |
| 5,265,781 | A | 11/1993 | Nichols | |
| 5,349,706 | A | 9/1994 | Keer | |
| 5,388,274 | A | 2/1995 | Glover et al. | |
| 5,413,262 | A | 5/1995 | Dewire et al. | |
| D361,658 | S | 8/1995 | Martin | |
| 5,441,185 | A | 8/1995 | Dragos | |
| 5,464,136 | A | 11/1995 | Eddy | |
| 5,470,000 | A | 11/1995 | Munoz | |
| 5,484,395 | A | 1/1996 | DeRoche | |
| 5,497,923 | A | 3/1996 | Pearson et al. | |
| 5,505,356 | A | 4/1996 | Noriega et al. | |
| 5,511,703 | A | 4/1996 | Ryerson | |
| 5,568,889 | A | 10/1996 | Holloway, Jr. et al. | |
| D378,633 | S | 4/1997 | Granito | |
| 5,653,337 | A | 8/1997 | Cirigliano | |
| 5,683,022 | A | 11/1997 | Evans | |
| 5,693,006 | A | 12/1997 | Slautterback | |
| 5,894,976 | A | 4/1999 | Harper | |
| D410,773 | S | 6/1999 | Case | |
| 5,964,386 | A | 10/1999 | Cote | |
| 6,119,909 | A | 9/2000 | Dancyger | |
| 6,179,185 | B1 | 1/2001 | Dancyger | |
| 6,213,365 | B1 | 4/2001 | Stocke et al. | |
| 6,244,485 | B1 | 6/2001 | Holland et al. | |
| 6,398,092 | B1 | 6/2002 | Ansley | |
| 6,446,852 | B1 | 9/2002 | Sorensen et al. | |
| 6,837,188 | B1 * | 1/2005 | Martin | A01K 27/005 119/792 |
| 8,342,137 | B1 * | 1/2013 | Burkhardt | A01K 27/004 119/770 |
| 8,919,292 | B1 * | 12/2014 | Wang | A01K 27/005 119/792 |
| 2004/0226972 | A1 * | 11/2004 | Cook | A45F 5/021 224/195 |
| 2008/0296327 | A1 * | 12/2008 | Murdoch | A45F 5/021 224/195 |
| 2011/0240705 | A1 | 10/2011 | Landano | |

* cited by examiner

UTILITY STRAP ASSEMBLY

CROSS-REFERENCE TO RELATED APPLICATIONS

This application is a continuation-in-part of U.S. application Ser. No. 15/226,320, filed Aug. 2, 2016, entitled "Utility Strap Assembly," which is a continuation of U.S. application Ser. No. 13/920,722, filed Jun. 18, 2013, entitled "Utility Belt Assembly," now U.S. Pat. No. 9,402,458—which are hereby incorporated herein by reference in their entirety, including all references cited therein.

BACKGROUND OF THE INVENTION

1. Field of the Invention

The present invention relates in general to a utility strap and/or belt assembly and, more particularly, to a utility strap/belt assembly which facilities non-impaired and/or essentially infinitely variable positioning of accessory items (e.g., a holster for a handgun, an ammunition magazine, a flashlight, a communication device such as a cellular phone and/or two-way radio, tools, etcetera) associated therewith. The utility strap/belt assembly of the present invention is also releasably securable to an article of clothing (e.g., pants, fatigues, capris, shorts, skirts, shirts jackets, etcetera) with or without the use of belt loops. The utility strap/belt assembly of the present invention further enables a user to rapidly convert the utility strap/belt assembly from a conventional daily wear type strap/belt into a full-utility (e.g., for law enforcement and/or tradesmen, such as builders, electricians) strap/belt that can hold a plurality of accessory items—and vice versa.

2. Background Art

Various types of utility straps/belts and associated accessory items have been known in the art for years, and are the subject of a plurality of publications and patents, including, for example: United States Patent Application Publication Number 2011/0240705 entitled "Ergonomic Rotatable Apparatus and Method for Use Thereof to Carry and Store Equipment and Accessories," U.S. Pat. No. 6,446,852 entitled "Belt Assembly for Storage and Inventory of Tools," U.S. Pat. No. 6,398,092 entitled "Carpenter's Belt with Lumbosacral Support, Looped Interchangeable Pouches, and Snaps for Suspenders," U.S. Pat. No. 5,265,781 entitled "Belt or Waistband Mountable Support for Article Carrier," U.S. Pat. No. 4,787,540 entitled "Hand Gun Holster Selectably Configured and to be Placed on a Belt," U.S. Pat. No. 4,463,455 entitled "Two Part Adjustable Belt with Locking Means," U.S. Pat. No. 4,342,410 entitled "Combination Hand Gun Holster and Belt," and U.S. Pat. No. 3,655,106 entitled "Gunbelt"—all of which are hereby incorporated herein by reference in their entirety including all references cited therein.

United States Patent Application Publication Number 2011/0240705 appears to disclose an ergonomic rotatable apparatus for carrying, storing and accessing accessories and field gear comprising a layered belt rail system and field gear pockets supported thereon.

U.S. Pat. No. 6,446,852 appears to disclose a tool-carrying assembly to be secured by a waist-encircling belt, and, additionally, by straps encircling the legs of a workman using the belt assembly. The assembly is thus stabilized, and enhanced weight distribution is achieved. Elements of the belt assembly include a waist-encircling band supporting a pair of laterally spaced, depending panels each carrying tool-accepting pockets. The pockets carry visual markings and coding as well as other indicia identifying the specific tools to be "housed" or carried in and to be returned to each pocket after use. Inventory control of the tools is thereby enhanced. Pivotal flaps depending from the band-carried panels serve to cover the tools when not in use, and to prevent the tools from scratching or otherwise marring any article, fixture, or "workpiece" requiring the workman's attention. The panels and the tools carried thereby are disposed in lateral, spaced zones at the wearer's sides (and not directly in the front of one's body) thus further to reduce any likelihood of the tools coming into damaging physical contact with an article being worked upon. That is, both frontal and rearwardly located zones about the wearer of the tool belt assembly are rendered essentially free and clear of all tools and other mechanical impediments. While wearing the tool assembly of the invention, a worker can, without any discomfort, lie upon and use a "creeper." A frontal sector of the belt itself is covered with a relatively soft, non-marring protective pad, composition, or surface material effective to prevent possible damage from a workman's belt buckle. An additional feature of the invention is that the panels may be structured to constitute a core sandwiched between a pair of encasing sheet-like webs. The resulting composite is readily formable to provide selectable visual patterns, designs or indicia, for example, to identify product name or sources and/or to constitute decorations.

U.S. Pat. No. 6,398,092 appears to disclose a rigid carpenter's belt with lumbosacral support that includes end sections to accept a plurality of interchangeable looped carpenter pouches with Velcro strips to attach the pouches to corresponding Velcro strips on the carpenter belt. The belt comprises a belt structure of leather having a buckle on one end and holes in the other end to form a releasable coupling and a central section of increased height, cephalad and caudoly, to provide lumbosacral support extending laterally within the central section and fabricated of foamlike material covered with split leather. Laterally disposed on opposite sides of the lumbosacral support.

U.S. Pat. No. 5,265,781 appears to disclose a mounting device for suspending a holster or other article carrier from a wearer's waistband or belt which is a U-shaped paddle member in one version for hooking over a wearer's waistband, and a plate with slots for receiving a belt in another version. Both the plate and one leg of the paddle member are provided with a pivot opening for receiving a first, pivotal fastener for pivotally connecting the devices to a holster, and a pair of arcuate slots positioned symmetrically one on each side of the pivot opening for receiving a pair of releasable fasteners for securing the holster in a selected angular position. The other leg of the paddle member is of arrowhead-like shape with its free end slightly pointed for easy insertion into the waistband, and a pair of inwardly directed barbs for fitting under the waistband to resist inadvertent pulling up and dislodging of the member. The plate can be rotated 180 degrees when the releasable fasteners are removed between a high ride and a low ride position.

U.S. Pat. No. 4,787,540 appears to disclose a hand gun holster to operationally hold a thirty eight revolver, an automatic pistol or another hand gun, that has a pair of belt loops made of polypropylene medium weight webbing in turn positioned and supported by a pair of curvable assemblies of heavy weight nylon webbing having sewn thereon respectively and cooperatively spaced heavy duty nap, (i.e., loop and hook fastening materials), with these pair of curvable assemblies being arranged in alignment to receive and to hold an automatic pistol, and being arranged perpendicularly to receive and to hold a thirty eight revolver.

U.S. Pat. No. 4,463,455 appears to disclose an adjustable two-part belt with locking means comprising elongated belt members which overlap each other and transverse members connected to the ends of the overlapping portions of the belt members and at least partially encircling the corresponding portions of the belt members. At least one of the transverse members includes a clamp means in the form of a metallic strip which encircles at least a portion of the overlapping belt members and which is bendable to clamp the overlapping portions of the belt members against each other to maintain the length adjustment of the belt. The metallic strip means is preferably in a C-shape.

U.S. Pat. No. 4,342,410 appears to disclose a combination handgun holster and belt. The combination comprises a holster having inner and outer side panels that assist in forming a tapering configuration for conformably receiving a handgun. The holster has an open end for insertion and withdrawal therethrough of the gun. The belt is attached to the inner side panel of the holster and suspends the holster on one side of the waist of a person. A retaining member is provided having first and second ends. The member is attached at the first end to the outer side panel of the open end of the holster. A means is provided for detachably mounting the second end of the retaining member to the belt. Thus when the retaining member is mounted to the belt the handgun is safely retained in the holster and cannot be withdrawn therefrom. A release means is provided which is attached to the belt for automatically detaching the retaining member from the belt. The release means is adapted to be activated by the hand opposite the side from which the holster is suspended. Thus when the retaining member is released from the belt the gun can be withdrawn from the holster. Such a combination holster and belt prevents the accidental removal of the gun from the holster, (e.g., in a chase, etcetera), or the removal of the gun from the holster by a person other than the person wearing the holster.

U.S. Pat. No. 3,655,106 appears to disclose a detachable holding device for an implement, particularly a weapon, to be carried, in diagonal position, by means of a sling arrangement, on the upper body, with at least one strap shackle, or the like, to which the holding device is attached, characterized by a preferably plate-shaped part, onto which a locking member made, preferably, of flexible material, may be slid on, which serves to maintain the part in the inserted position on the strap shackle, and provided with a flange which does not pass through the strap shackle, to which is connected a suspending member which, with the suspending of the implement, serves to engage into a fastening device provided on the sling arrangement.

While the above-identified publications and patents do appear to disclose various types of utility strap/belt assemblies, their configurations remain problematic for a plurality or reasons, including, but not limited to, limited positioning of accessory items, limited adaptability and/or securement to an article of clothing, and/or limited conversion from conventional to utility configurations and vice versa—among other things.

It is therefore an object of the present invention to provide a utility strap/belt assembly that, among other things, remedies the aforementioned detriments and/or complications associated with the use of the above-identified, utility belt assemblies and associated accessories and articles of clothing.

These and other objects of the present invention will become apparent in light of the present specification, claims, and appended drawings.

SUMMARY OF THE INVENTION

In one embodiment, the present invention is directed to a utility strap assembly for use in association with an article of clothing, for integration with an article of clothing, and/or to be worn by a user, comprising: (a) a primary strap member, wherein the primary strap member includes a length, a height, a thickness, a first end, a second end, an inner surface, an outer surface, an upper end, and a lower end; (b) a first bracket, wherein the first bracket is positioned on at least one of the inner surface and the outer surface of the belt member; (c) a second bracket, wherein the second bracket is positioned on at least one of the inner surface and the outer surface of the belt member; (d) wherein the first bracket and the second bracket are spaced apart from one another to define a track therebetween; (e) wherein a hook fastener material is associated with at least a portion of the inner surface of the primary strap member; (f) wherein a loop fastener material is associated with at least a portion of the outer surface of the primary strap member; and (g) wherein the hook and loop fastener materials cooperate to releasably secure the primary strap member on, to and/or around a user.

In a preferred embodiment of the present invention, the utility strap assembly further comprises an accessory member, wherein the accessory member includes a guide member slidably positioned at least one of on and within the track. In this embodiment, the accessory member preferably comprises, for example, a holster for a handgun, an ammunition magazine, a flashlight, a communication device such as a cellular phone and/or two-way radio, tools, etcetera.

In another preferred embodiment of the present invention, the first bracket is positioned on the outer surface of the primary strap member proximate the upper end thereof and the second bracket is positioned on the outer surface of the primary strap member proximate the lower end thereof, and wherein the first bracket and the second bracket are spaced apart from one another to define a track therebetween.

In yet another preferred embodiment of the present invention, the track extends continuously from approximately the first end to approximately the second end of the strap member.

In another aspect of the present invention, the utility strap assembly preferably comprises a secondary strap member, wherein the secondary strap member includes a length, a height, a thickness, a first end, a second end, an inner surface, an outer surface, an upper end, and a lower end, wherein a hook fastener material is associated with at least a portion of the inner surface of the secondary strap member, wherein a loop fastener material is associated with at least a portion of the outer surface of the secondary strap member, and wherein at least a portion of the outer surface of the secondary strap member is secured to at least a portion of the inner surface of the primary strap member.

The present invention is also directed to a utility strap assembly for use in association with an article of clothing, for integration with an article of clothing, and/or to be worn by a user, comprising: (a) a primary strap member, wherein the primary strap member includes a length, a height, a thickness, a first end, a second end, an inner surface, an outer surface, an upper end, and a lower end; (b) a first bracket, wherein the first bracket is positioned on at least one of the inner surface and the outer surface of the belt member; (c) a second bracket, wherein the second bracket is positioned on at least one of the inner surface and the outer surface of the belt member; (d) wherein the first bracket and the second bracket are spaced apart from one another to define a track therebetween; (e) wherein a hook fastener material is associated with at least a portion of the inner surface of the primary strap member; (f) wherein a loop fastener material is associated with at least a portion of the outer surface of the primary strap member; (g) wherein the hook and loop fastener materials cooperate to releasably secure the primary strap member on, to and/or around a user; (h) a secondary strap member, wherein the secondary strap member includes a length, a height, a thickness, a first end, a second end, an inner surface, an outer surface, an upper end, and a lower end; (i) wherein a hook fastener material is associated with at least a portion of the inner surface of the secondary strap member; (j) wherein a loop fastener material is associated with at least a portion of the outer surface of the secondary strap member; and (k) wherein at least a portion of the outer surface of the secondary strap member is secured to at least a portion of the inner surface of the primary strap member.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive have been omitted. It will be further understood that the invention is not necessarily limited to the particular embodiments illustrated herein.

The invention will now be described with reference to the drawings wherein.

DETAILED DESCRIPTION OF THE INVENTION

Figure 1:
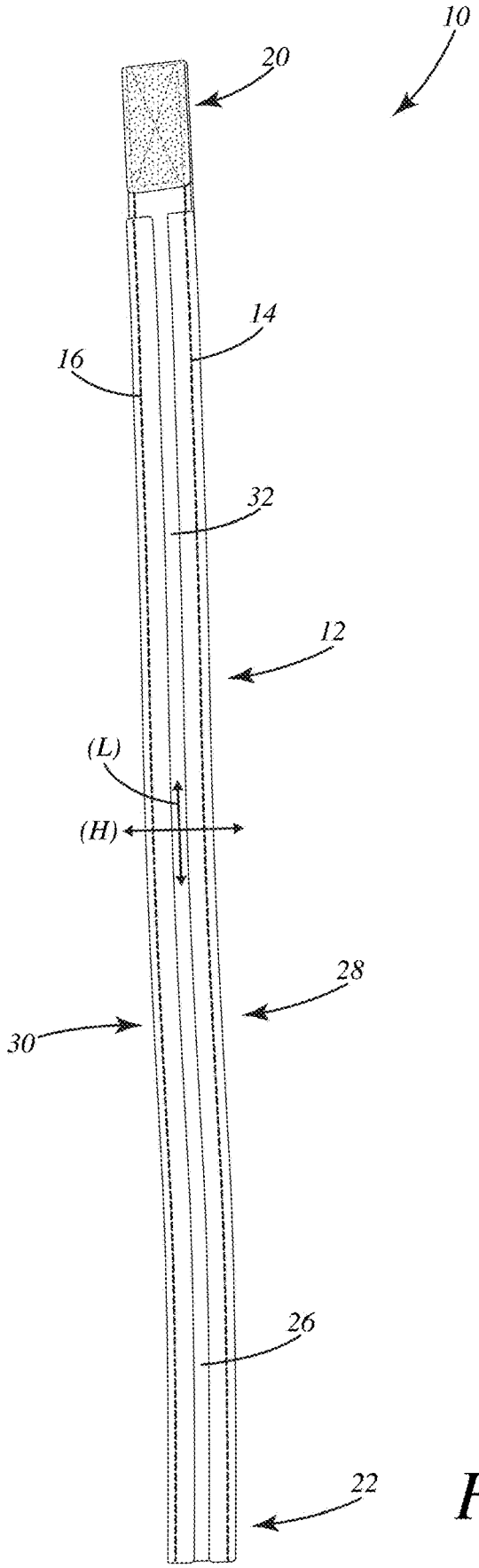
FIG. 1 of the drawings is a top plan view of a primary strap member, fabricated in accordance with the present invention, showing the outer surface thereof.

While this invention is susceptible of embodiment in many different forms, there are shown in the drawings, and will herein be described in detail, several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters.

Figure 2:
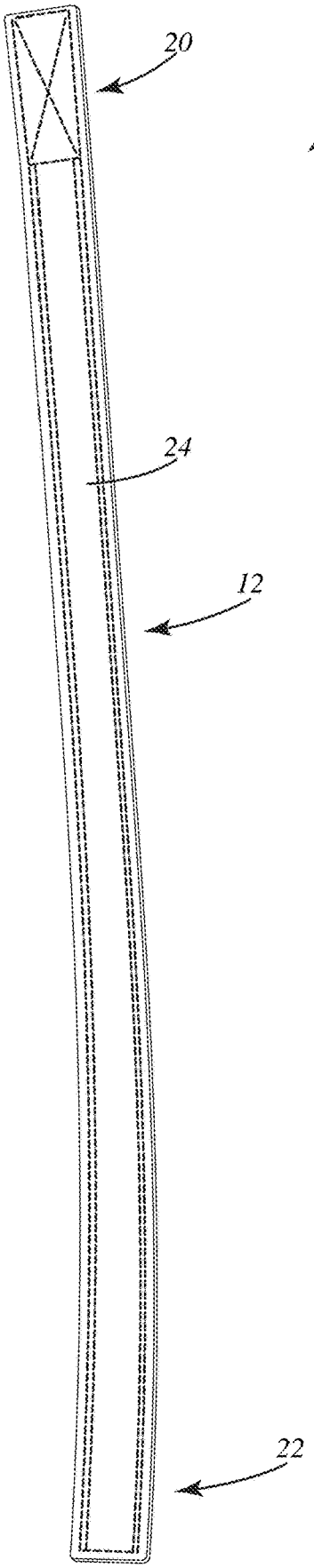
FIG. 2 of the drawings is a top plan view of the primary strap member of FIG. 1, showing the inner surface thereof.
Figure 3:
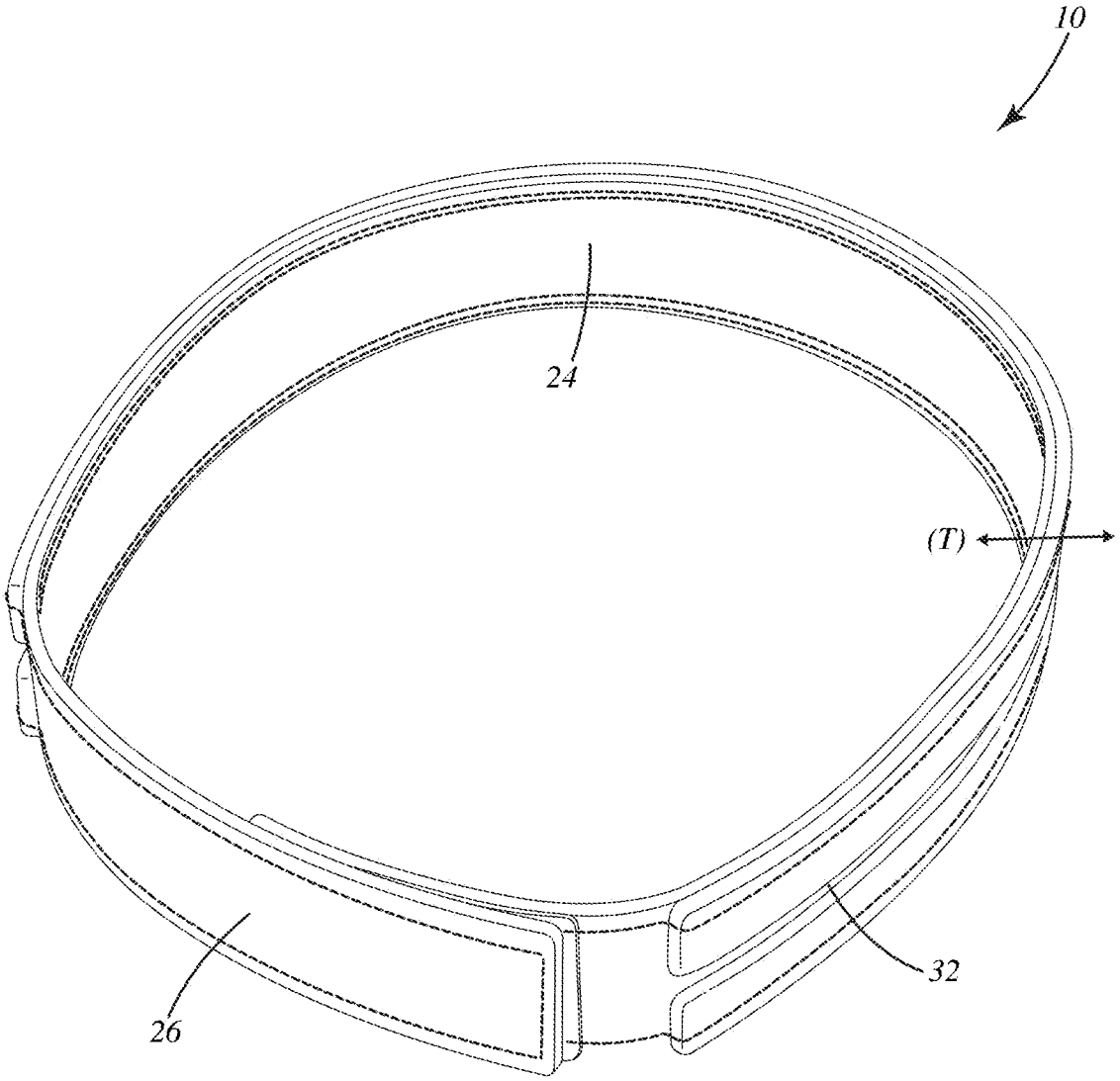
FIG. 3 of the drawings is a perspective view of the primary strap member of FIG. 1.

Referring now to the drawings, and to FIGS. 1-3 collectively, a first embodiment of utility strap assembly 10 is shown which generally comprises primary strap member 12, first bracket 14, and second bracket 16. It will be understood that utility strap assembly 10 facilities non-impaired and/or essentially infinitely variable positioning of accessory member 18 (See FIGS. 8-9; e.g., a holster for a handgun, an ammunition magazine, a flashlight, a communication device such as a cellular phone and/or two-way radio, tools, etcetera) releasably secured thereto compared to a conventional belt and looped article of clothing configurations. Utility strap assembly 10 is also advantageously releasably securable to articles of clothing (e.g., pants, fatigues, capris, shorts, skirts, shirts, jackets, etcetera) without the use of belt loops. For purposes of the present invention, utility strap assembly 10 may be associated with, for example, the waist, arm, leg, shoulder, chest, and/or torso of an associated user. It will be further understood that FIGS. 1-9 provided herein are merely representations of utility strap assembly 10. As such, some of the components may be distorted from their actual scale for pictorial clarity and/or image enhancement.

Referring once again to FIGS. 1-3 collectively, in one embodiment, primary strap member 12 includes first end 20, second end 22, inner surface 24, outer surface 26, upper end 28, lower end 30, length (L), height (H), and thickness (T). Primary strap member 12 is preferably fabricated from leather, plastics, rubbers, natural and/or synthetic materials, and composites of the same—just to name a few.

As is best shown in FIGS. 1-3 and 8, in one embodiment, first bracket 14 is positioned on outer surface 26 of primary strap member 12. First bracket 14 preferably comprises a substantially L-shaped bracket. However, other bracket configurations that would be known to those with ordinary skill in the art having the present disclosure before them are likewise contemplated for use. First bracket 14 is preferably fabricated from metals, woods, natural and/or synthetic materials, and composites of the same—just to name a few.

Second bracket 16 is positioned on outer surface 26 of primary strap member 12. Second bracket 16 preferably comprises a substantially L-shaped bracket. However, other bracket configurations that would be known to those with ordinary skill in the art having the present disclosure before them are likewise contemplated for use. Similar to first bracket 14, second bracket 16 is preferably fabricated from metals, woods, natural and/or synthetic materials, and composites of the same—just to name a few.

Figure 8:
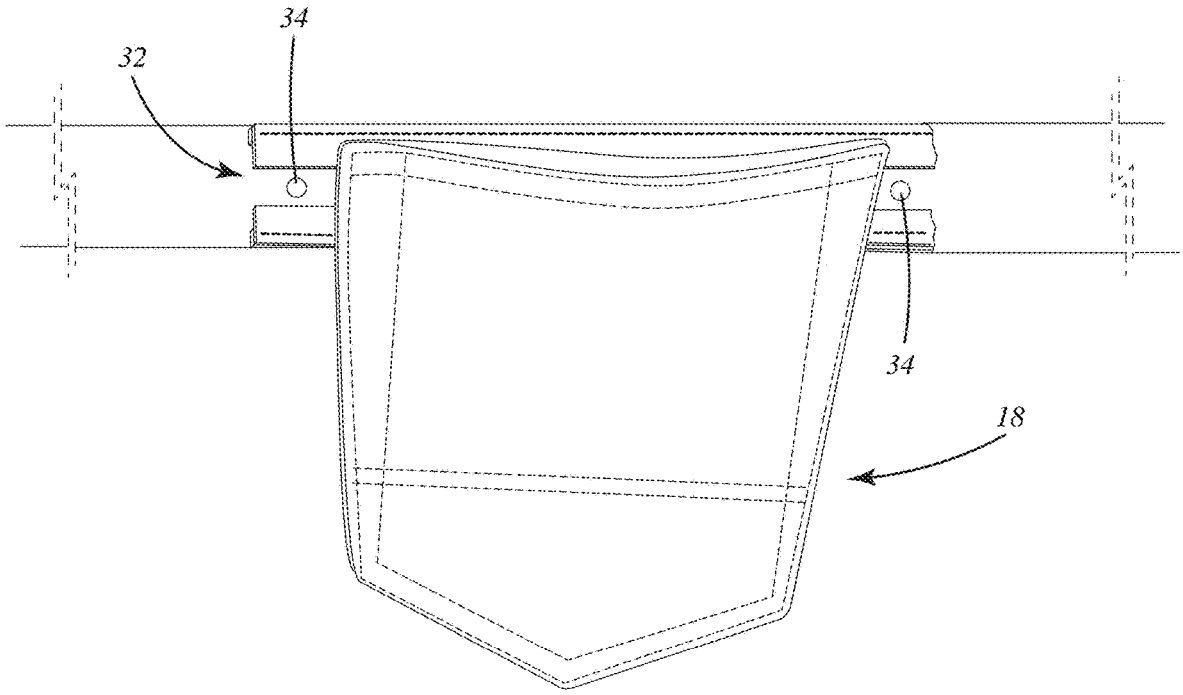
FIG. 8 of the drawings is a fragmented perspective view of a utility strap assembly associated with an accessory member.

As is best shown in FIGS. 1, 3, and 8, in one embodiment, first bracket 14 and second bracket 16 are spaced apart from one another to define track 32 therebetween.

As is also best shown in FIGS. 1, 3, and 8, in a preferred embodiment of the present invention, first bracket 14 is positioned on outer surface 26 of primary strap member 12 proximate upper end 28 and second bracket 16 is positioned on outer surface 26 of primary strap member 12 proximate lower end 30. Track 32 is positioned between first bracket 14 and second bracket 16.

While track 32 extends from approximately first end 20 of primary strap member 12 to approximately second end 22 of primary strap member 12, it may also extend continuously and/or intermittently for any portion of length (L) of primary strap member 12.

As is best shown in FIG. 8, track 32 may optionally comprise one or more stop tabs 34 for regulating displacement of accessory member 18.

As is best shown in FIGS. 1-3 a hook fastener material is preferably associated with at least a portion of inner surface 24 of primary strap member 12, and a loop fastener material is preferably associated with at least a portion of outer surface 26 of primary strap member 12. During normal operation, these hook and loop fastener materials cooperate to releasably secure primary strap member 12 on, to and/or around a user. Primary strap member 12 may be used with or without secondary strap member 40 (See FIGS. 4-7).

Figure 4:
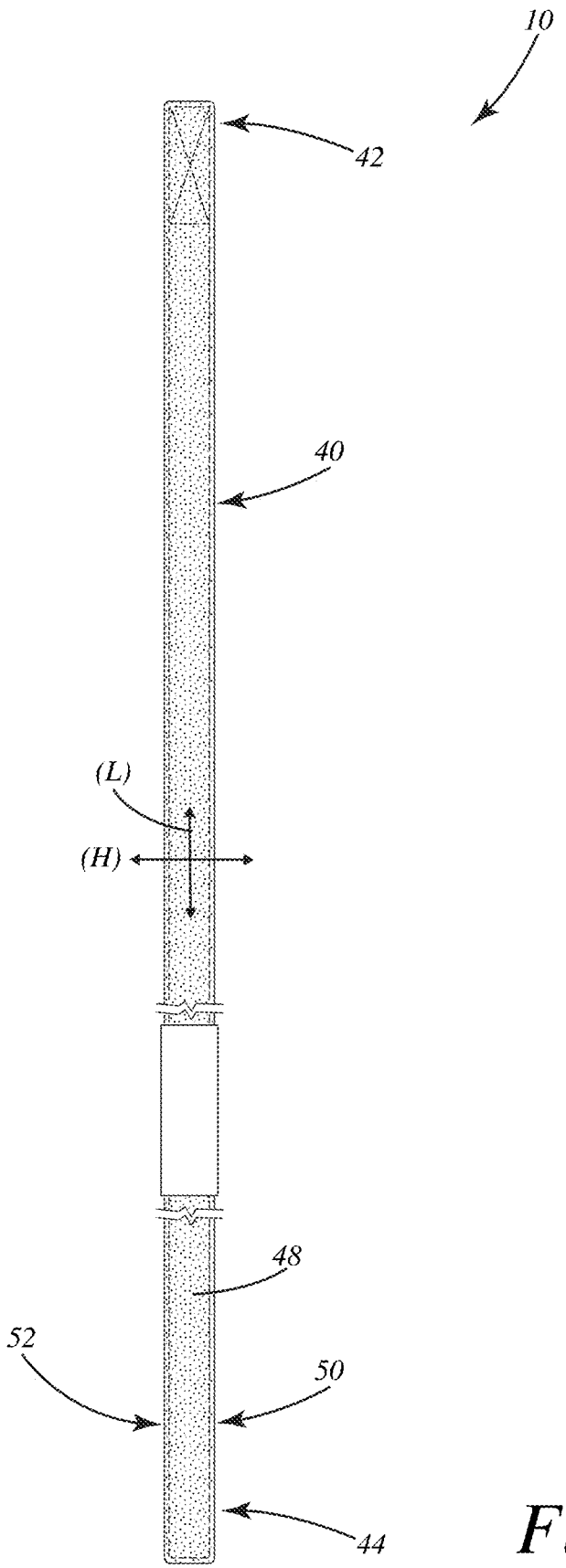
FIG. 4 of the drawings is a top plan view of a secondary strap member, fabricated in accordance with the present invention, showing the outer surface thereof.
Figure 5:
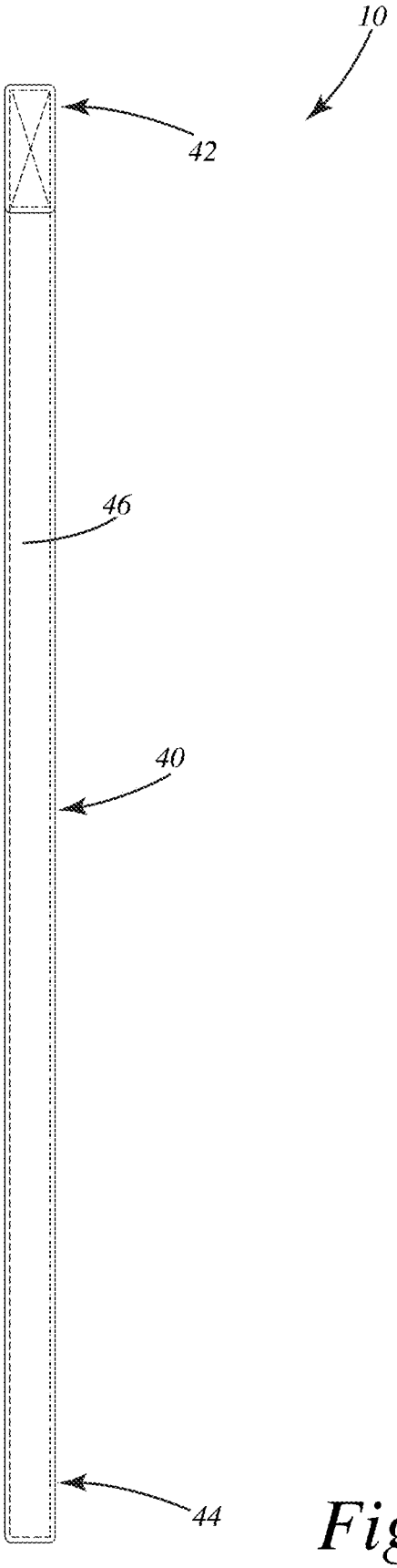
FIG. 5 of the drawings is a top plan view of the secondary strap member of FIG. 4, showing the inner surface thereof.
Figure 6:
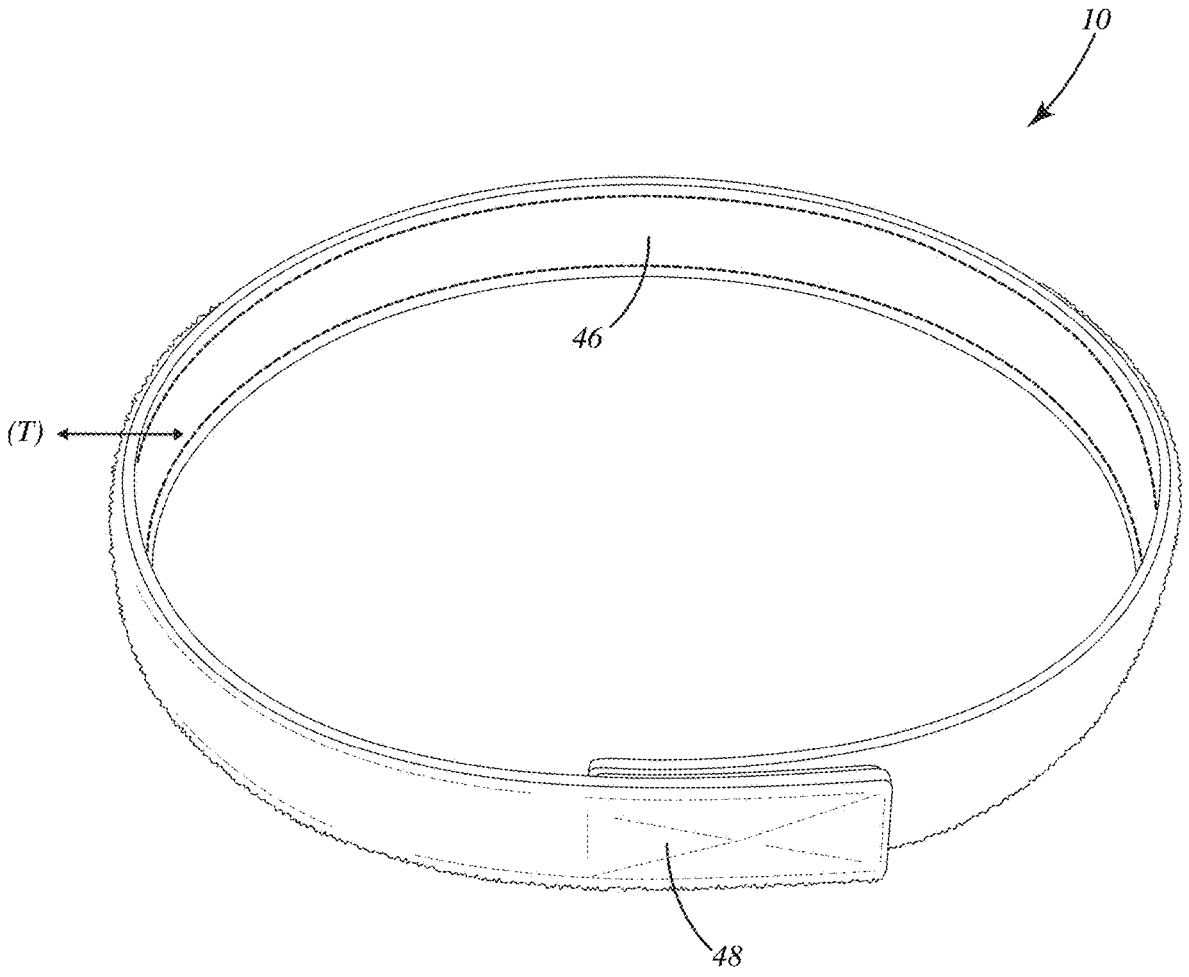
FIG. 6 of the drawings is a perspective view of the secondary strap member of FIG. 5.

Referring now to FIGS. 4-6 collectively, in one embodiment, secondary strap member 40 includes first end 42, second end 44, inner surface 46, outer surface 48, upper end 50, lower end 52, length (L), height (H), and thickness (T). Secondary strap member 40 is preferably fabricated from leather, plastics, rubbers, natural and/or synthetic materials, and composites of the same—just to name a few.

In a preferred embodiment of the present invention, a hook fastener material is preferably associated with at least a portion of inner surface 46 of secondary strap member 40, and a loop fastener material is preferably associated with at least a portion of outer surface 48 of secondary strap member 40. During normal operation, these hook and loop fastener materials cooperate to releasably secure secondary strap member 40 on, to and/or around a user.

As is best shown in FIG. 4, a decorative and/or aesthetic layer may be releasably secured to at least a portion of the outer surface of the secondary strap member. This decorative layer preferably includes an outer surface that looks like a conventional belt and in inner surface that includes hook type fastener material.

Figure 7:
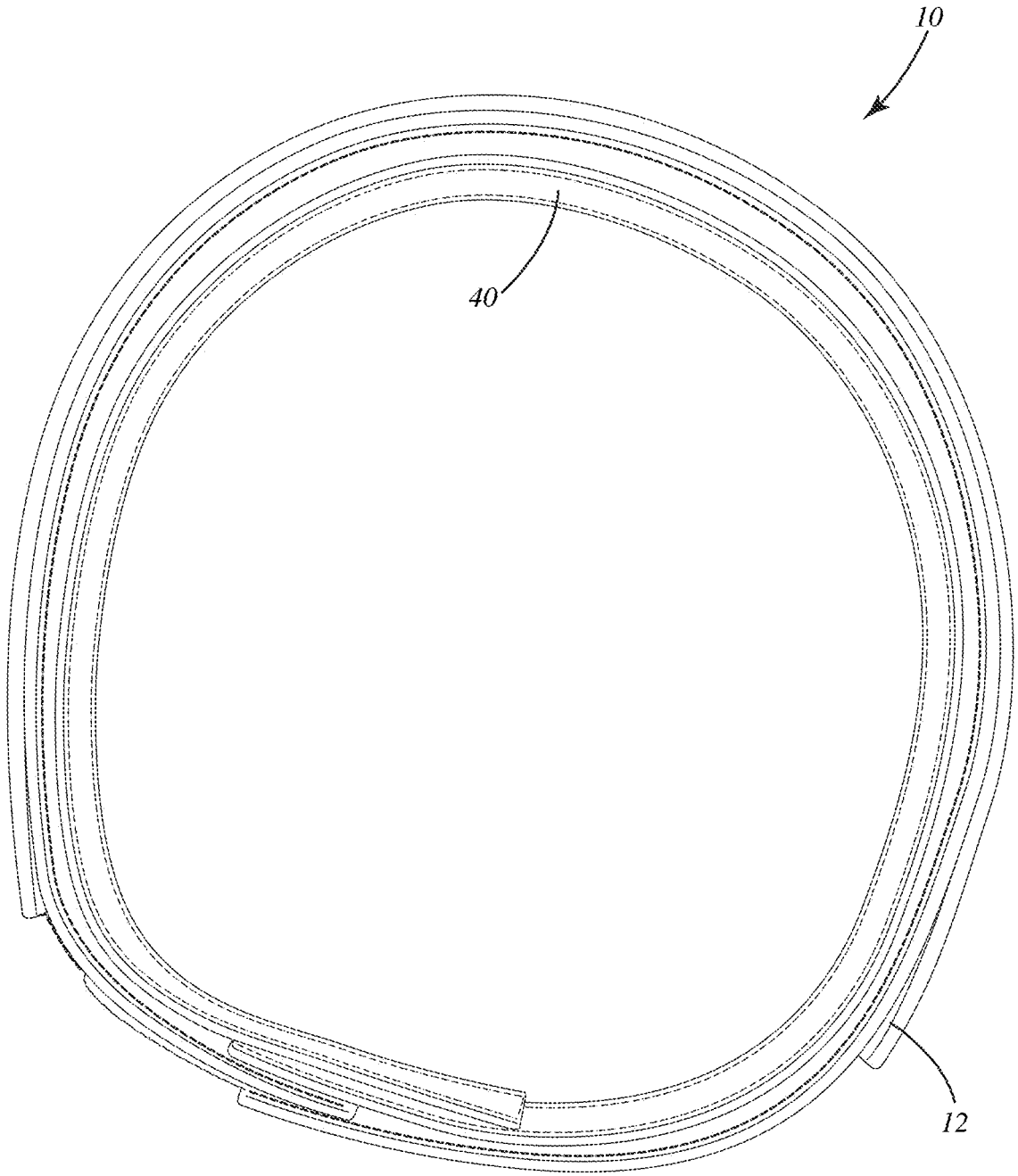
FIG. 7 of the drawings is a top plan view of the primary strap member of FIG. 1 associated with the secondary strap member of FIG. 4.

As is best shown in FIG. 7, utility strap assembly 10 preferably includes the inner surface of primary strap member 12 releasably secured to the outer surface of secondary strap member 40.

In certain embodiments of the present invention, utility strap assembly 10 comprises conductive traces that facilitate provision of electricity to and/or throughout the utility strap assembly. These conductive traces may include, for example, conductive metal, wire, ink, paint, etcetera. In one embodiment of the present invention, a power supply is also associated with the utility strap assembly. More specifically, the power supply is preferably associated with the conductive traces and primary strap member 12.

Figure 9:
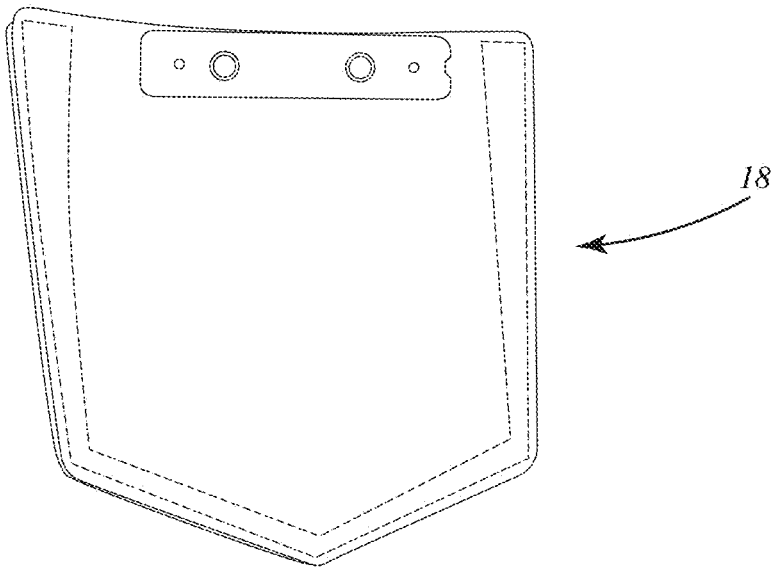
FIG. 9 of the drawings is a perspective view of an accessory member (e.g., a holster) fabricated in accordance with the present invention.
Figure 10:
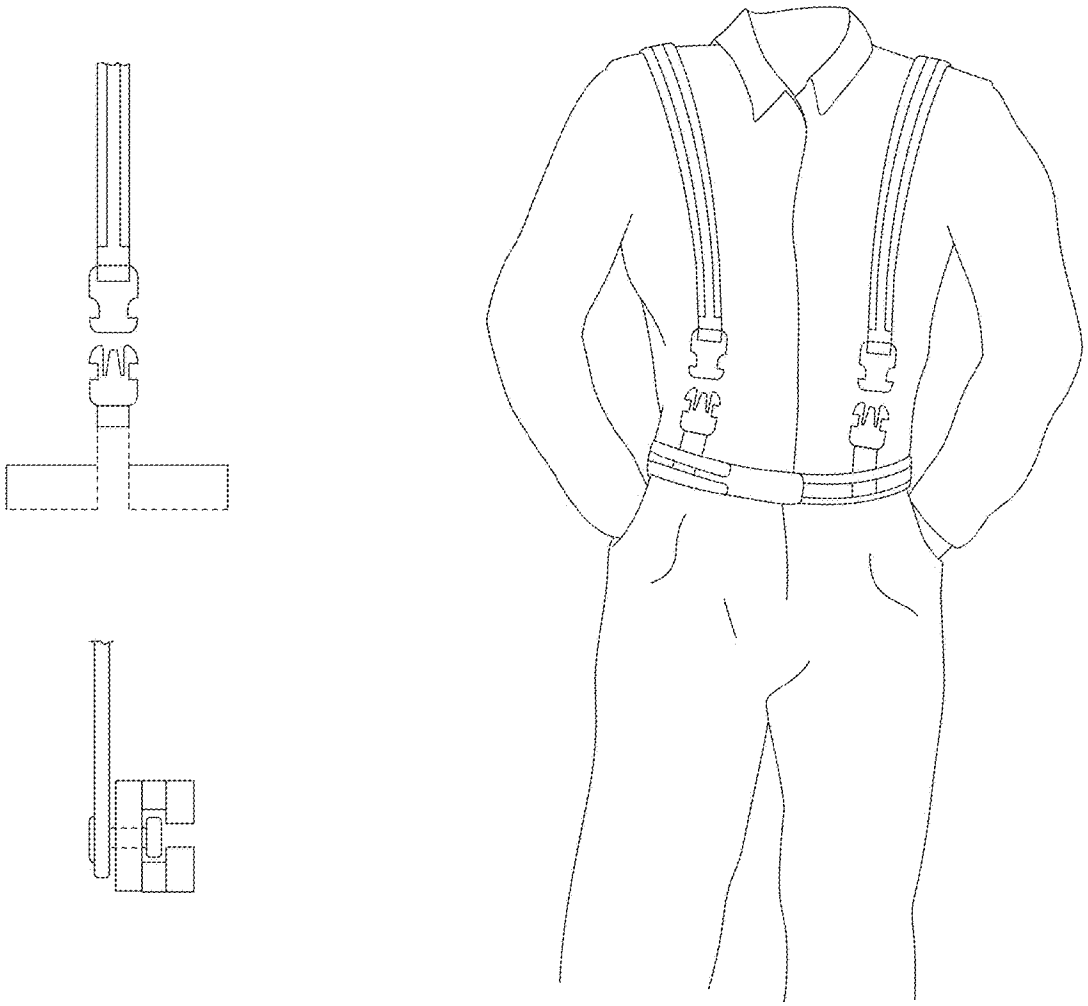
FIGS. 10-11 of the drawings show additional and/or alternative embodiments of a utility strap/belt assembly.
Figure 11:
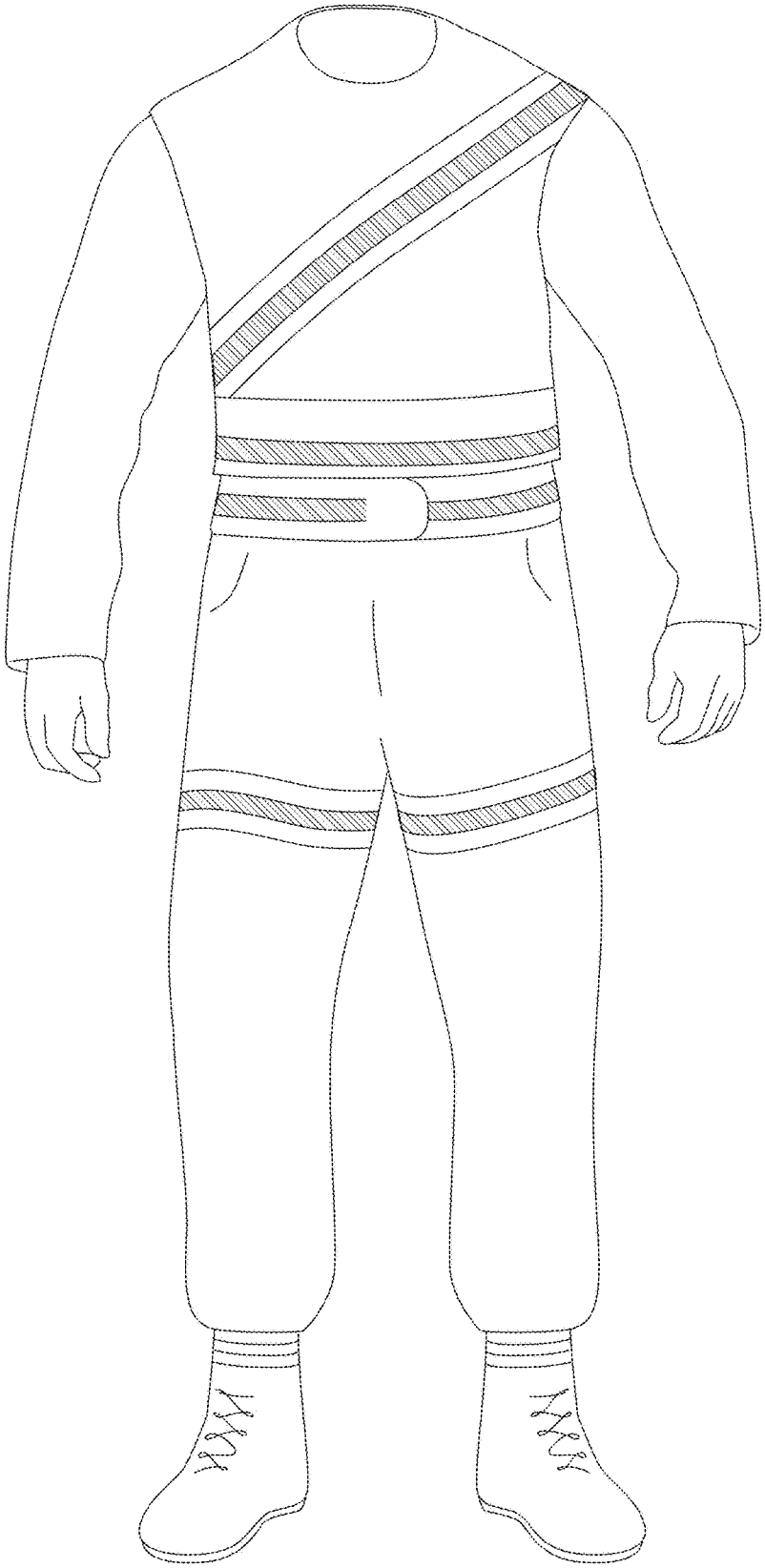

Referring now to FIGS. 8-9, accessory member 18 preferably includes a guide member which is slidably positioned within track 32. The guide member is preferably releasably associated with accessory member 18 via, for example, snaps, hook and loop fasteners, buttons, zippers, selective adhesives.

In accordance with the present invention, accessory member 18 preferably includes, for example, a holster for a handgun, an ammunition magazine, a flashlight, a communication device such as a cellular phone and/or two-way radio, tools—just to name a few.

The foregoing description merely explains and illustrates the invention, and the invention is not limited thereto except insofar as the appended claims are so limited, as those skilled in the art who have the disclosure before them will be able to make modifications without departing from the scope of the invention.

What is claimed and desired to be secured by Letters Patent of the United States is:

1. An assembly, comprising:

a first layer, wherein the first layer is an article of clothing worn by a user;

a second layer secured to and positioned on the first layer, wherein the second layer is a hook or loop fastener material;

a third layer secured to and positioned on the second layer, wherein the third layer is a primary strap member, wherein the primary strap member includes a length, a height, a thickness, a first end, a second end, an inner surface, an outer surface, a top end, and a bottom end;

a fourth layer secured to and positioned on the third layer, wherein the fourth layer comprises first and second brackets;

wherein the first bracket includes a first upright component and a second horizontal component, wherein the second component is orthogonal to the first component and parallel to the outer surface of the primary strap member, wherein the first bracket is L-shaped and positioned on the outer surface of the primary strap member at the top end thereof;

wherein the second bracket includes a first upright component and a second horizontal component, wherein the second component is orthogonal to the first component and parallel to the outer surface of the primary strap member, wherein the second bracket is L-shaped and positioned on the outer surface of the primary strap member at the bottom end thereof;

wherein the first bracket and the second bracket are spaced apart from one another to cooperatively form a singular inwardly facing track therebetween;

wherein a hook or loop fastener material is present between the first end and the second end of the inner surface of the primary strap member;

wherein a hook or loop fastener material is associated with at least a portion of the outer surface of the primary strap member; and wherein the hook and loop fastener present on the inner surface of the primary strap member is releasably secured to the second layer.

2. The utility strap assembly according to claim 1, further comprising an accessory member, wherein the accessory member includes a guide member slidably positioned at least one of on and within the track.

3. The utility strap assembly according to claim 2, wherein the accessory member comprises a holster.

* * * * *